US006612130B2

(12) United States Patent
Ito

(10) Patent No.: US 6,612,130 B2
(45) Date of Patent: Sep. 2, 2003

(54) NECKLACE

(75) Inventor: Takashi Ito, Hyogo (JP)

(73) Assignee: Rokko Pearl Trading Co., Ltd, Hyogo (JP)

( * ) Notice: Subject to any disclaimer, the term of this patent is extended or adjusted under 35 U.S.C. 154(b) by 0 days.

(21) Appl. No.: 10/029,993

(22) Filed: Dec. 31, 2001

(65) Prior Publication Data

US 2002/0059808 A1 May 23, 2002

Related U.S. Application Data

(62) Division of application No. 09/484,266, filed on Jan. 18, 2000, now Pat. No. 6,349,568.

(30) Foreign Application Priority Data

Jan. 22, 1999 (JP) ..... 11-14485
Nov. 11, 1999 (JP) ..... 11-321004

(51) Int. Cl.[7] ..... A44C 5/00

(52) U.S. Cl. ..... 63/3; 63/3.1; 63/3.2; 63/4; 63/29.2; 63/900; 24/116 A; 24/303; 24/DIG. 47

(58) Field of Search ..... 63/3, 3.1, 3.2, 63/4, 29.2, 41, 900; 24/115 F, 602, 116 A, 303, 598.2, DIG. 43, DIG. 47

(56) References Cited

U.S. PATENT DOCUMENTS

| | | | | |
|---|---|---|---|---|
| 1,421,876 A | * | 7/1922 | Weed | 24/574.1 |
| 1,522,297 A | * | 1/1925 | Godsol | 40/662 |
| 1,548,274 A | | 8/1925 | Mitchell | |
| 1,720,472 A | | 7/1929 | Gagnon | |
| 1,740,992 A | | 12/1929 | McCretton | |
| 2,260,700 A | * | 10/1941 | Bloom et al. | 24/3.13 |
| 2,296,197 A | | 9/1942 | Bloom et al. | 24/3.13 |
| 2,521,589 A | | 9/1950 | Livingston | |
| 2,529,058 A | | 11/1950 | Tell et al. | 33/555.4 |
| 2,615,227 A | * | 10/1952 | Hornik | 24/303 |
| 2,693,626 A | * | 11/1954 | Harrison | 24/598.2 |
| 3,094,754 A | | 6/1963 | Wayne | 24/116 R |
| 3,168,768 A | | 2/1965 | Bohlinger et al. | 24/116 A |
| 3,170,311 A | | 2/1965 | Raphael | 63/3.1 |
| 3,208,238 A | | 9/1965 | Spitzer | 63/3.1 |
| 4,530,221 A | | 7/1985 | Weinberg | 63/3.2 |
| 4,573,243 A | | 3/1986 | Plaza | |
| 5,007,252 A | | 4/1991 | Mochizuki | 63/3 |
| 5,018,250 A | | 5/1991 | Schroder | 24/116 A |
| 5,349,725 A | * | 9/1994 | Levy | 24/303 |
| 5,979,184 A | | 11/1999 | Razza | 63/1.11 |
| 6,243,929 B1 | * | 6/2001 | Curwood | 24/598.2 |
| 6,349,568 B1 | * | 2/2002 | Ito | 63/3 |

FOREIGN PATENT DOCUMENTS

DE 17 57 081 3/1971

* cited by examiner

*Primary Examiner*—Andrea Chop
(74) *Attorney, Agent, or Firm*—Wenderoth, Lind & Ponack, L.L.P.

(57) ABSTRACT

A necklace has an adjustable loop size so that anyone having a thick or a slender neck can wear a necklace of one size so which is adjustable that it fits the wearer best. A hook formed by bending a material is provided at an end of the string necklace, formed by connecting pearls together with a string. A loop is formed by engaging the hook in a valley portion between any adjacent pearls. By engaging the hook in different valleys, it is possible to change the size of the necklace loop freely, so that it is possible to form a loop of the best size for each wearer.

3 Claims, 6 Drawing Sheets

NECKLACE

This application is a Divisional Application of application Ser. No. 09/484,266, filed Jan. 18, 2000, now U.S. Pat. No. 6,349,568, issued Feb. 26, 2002.

BACKGROUND OF THE INVENTION

This invention relates to a string necklace formed by connecting many pearls or other spherical objects in a line.

Short necklaces such as a choker, a princess and matinee (which are designations used to indicate the lengths of pearl necklaces), cannot be pulled over the head unlike a rope necklace. Thus, a string necklace (formed by connecting many spherical objects by passing a thread therethrough) is formed linearly, and both ends of the string necklace are detachably connected together.

Various fasteners for connecting both ends of a string necklace together are known. A typical fastener for neck chains comprises a pulling eye and a plate engageable with the pulling eye. But if a pulling eye is used for a necklace, the joint portion tends to stick out like a sore thumb, impairing the decorative effect. Thus, plug-in clasps or center-bend type clasps with or without decorations added thereto are often used as design points so that the joint portion can be moved to one side or to the front.

In any case, such conventional fasters all consist of a male member provided at one end of the string necklace and a female member provided at the other end.

The lengths of ready-made necklaces are standardized. For example, among pearl necklaces A, a choker type (FIG. 8A) is about 35 cm long, a princess type (FIG. 8B) is about 40–43 cm long, a matinee type (FIG. 8C) is about 53 cm long, and a opera type (FIG. 8D) is about 71 cm long. The choker type is worn rather tightly around the wearer's neck as shown in FIG. 8A. The princess, matinee and opera necklaces hang more loosely than the choker necklace in this order, but the fit varies with the wearer's build and neck thickness. For example, choker and princess necklaces will look like princess and matinee necklaces, respectively, if worn by a person with a slender neck. Conversely, matinee and princess necklaces worn by a thick-necked person will look like princess and choker necklaces, respectively.

Since the fit changes according to the wearer's build and neck thickness, the necklace may sometimes not go well with the clothes. Thus, the inventor considered adjusting the length of a string necklace. If the length of a necklace is freely adjustable, it is possible to prevent changes in fit according to the wearer's neck thickness. Also, it is possible to use one necklace in different ways.

Neck chains having an adjuster (which is also a chain) so that its length is adjustable are already known. If, however, the adjuster of this type were used for a necklace, it would totally spoil the beauty of the necklace.

An object of this invention is to provide a necklace which makes it possible to adjust the length of a string necklace (that is, the size of its ring portion) without lessening its aesthetic beauty.

SUMMARY OF THE INVENTION

According to this invention, there is provided a necklace comprising a string, a plurality of spherical objects connected together by passing the string therethrough, and a hook provided at one end of the string. The hook has an openable closed loop and is engageable to a portion between adjacent spherical objects.

With this arrangement, the size of the ring portion is adjustable practically in a stepless manner by engaging the hook in one of the valley portions between the spherical objects.

When the hook is engaged in a valley remote from the other end of the string, part of the string hangs from the joint portion. This design looks new and original.

Since the hook is formed simply by bending a blank, the fastener can be manufactured at a low cost.

Pearls are the most preferable spherical objects because cultured pearls are now easily available, and every woman likes pearls. Also, because pearls are nearly true spheres, the hook is easily engageable and disengageable.

Preferably, the free end of the hook is bent outwardly and a decoration is mounted on the free end to make the hook less prominent and to increase the attractiveness of the necklace by using the decoration as a design feature.

Other features and objects of the present invention will become apparent from the following description made with reference to the accompanying drawings, in which:

DETAILED DESCRIPTION OF THE PREFERRED EMBODIMENT

Figure 1:
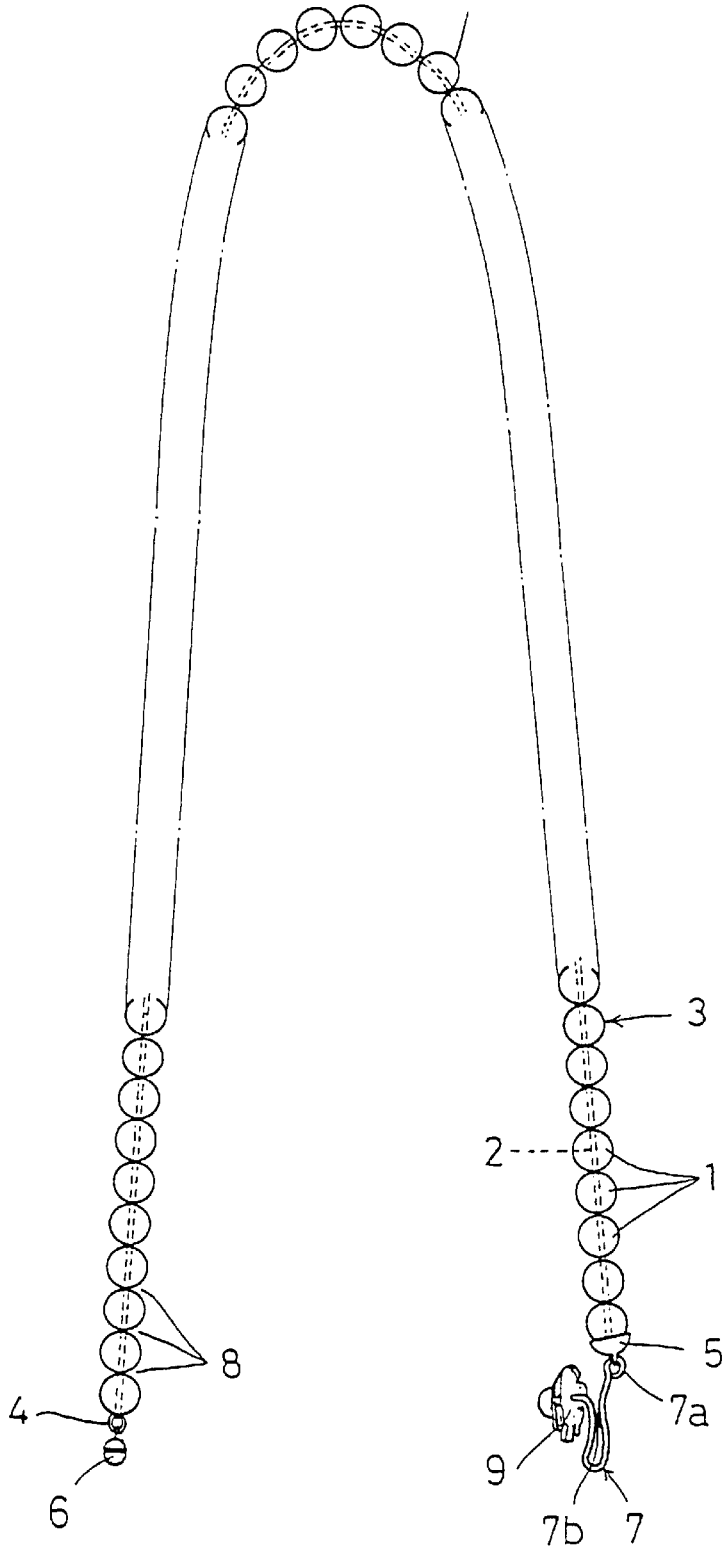
FIG. 1 is a front view of a necklace embodying this invention.
Figure 2:
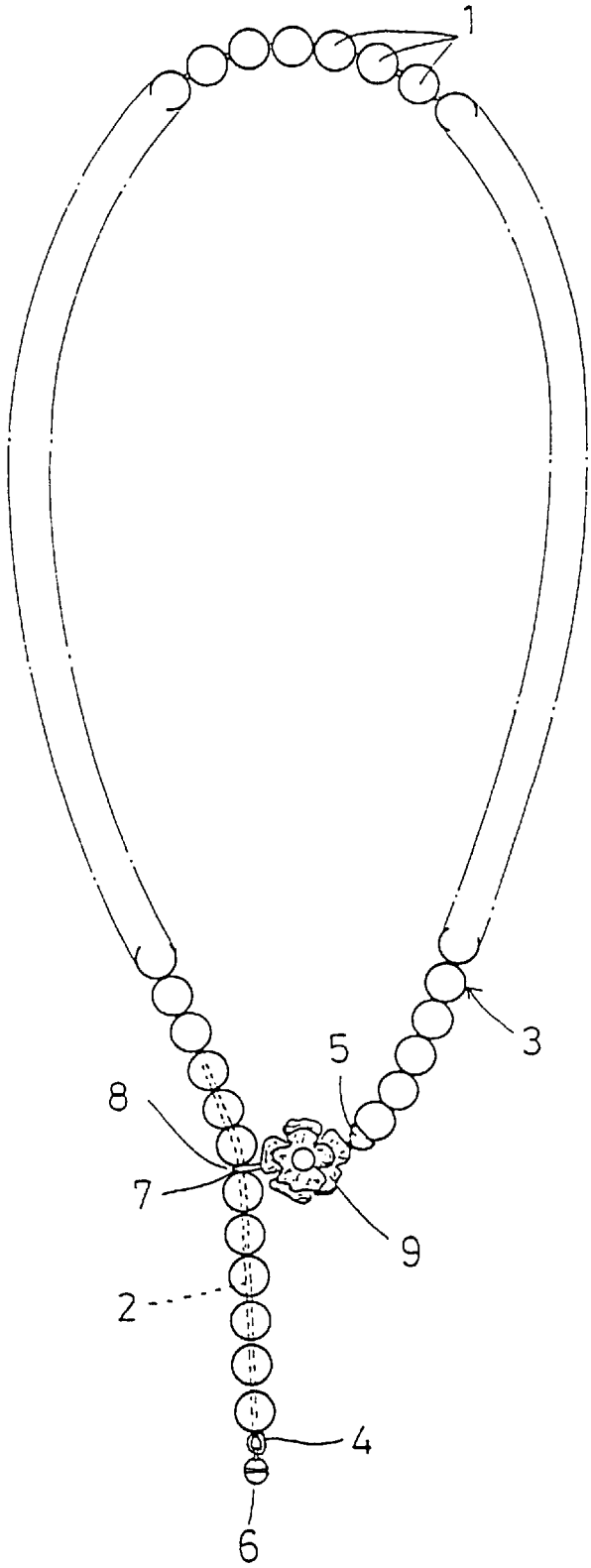
FIG. 2 is a front view of the necklace of the present invention showing how the ends are connected.
Figure 3:
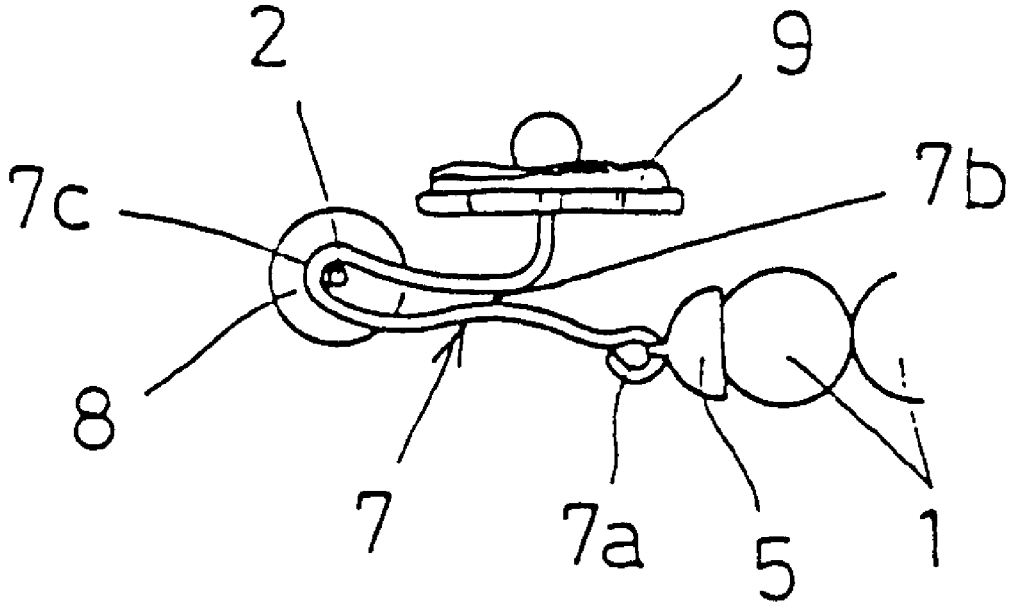
FIG. 3 is a side view showing an example of a hook of the present invention.

FIGS. 1 and 2 show a necklace embodying this invention. The necklace shown is a pearl necklace comprising many pearls 1.

The pearls 1 are connected together by a string 2 passed through small holes (not shown) formed in the center of the pearls to form a string of pearls. A stop ring 4 is provided at a first end of the string 2 to prevent pearls from dropping from this end, and at the second end, a stopper is provided to prevent pearls from dropping from this end. This stopper is hidden in a cap-shaped decoration 5 bonded to a pearl at the second end of the string.

The necklace of the embodiment has a silver decoration ball 6 hanging from the stop ring 4 for better appearance, but this is not an essential element.

As the string 2, a silk string is used in the embodiment, but a nylon string or a flexible wire may be used instead.

The decoration 5 is a metallic piece with a hole in which is engaged a hook 7. The hook is formed by bending a spring wire made from a silver-phosphor bronze alloy. It has a ring portion 7*a* engaged in the hole of the decoration 5, and is bent near its free end to form a hook portion which is a closed loop. Near the tip, the hook 7 is further bent outwardly at an angle of about 90°.

The hook 7 may be made of a material other than a silver alloy, as long as it is resilient. For example, the hook may be made of an 18-carat gold, platinum or any other precious metal-based material or a material not containing a precious metal. Also, the hook may be formed by bending a strip of plate.

The hook 7 is engaged in one of valleys 8 formed between the adjacent pearls 1 to form a ring.

When the hook 7 is engaged in or disengaged from a valley 8, the inlet 7*b* of the closed loop of the hook 7 is pushed open by the pearls 1. When the valley 8 is completely pushed into the loop or is pulled out of the loop, the inlet 7*b* will close again due to the resilience of the hook 7. Thus, once the hook 7 is completely engaged in a valley 8, it will never disengage spontaneously.

A decoration 9 carrying a pearl may be brazed to the free end of the hook 7. It is petal-shaped in the embodiment, but may be of any other design. If the necklace is worn such that the decoration 9 is in the front or at one side of the necklace, it will look more attractive.

FIG. 2 shows how the hook 7 is engaged in a valley 8 of a string of pearls. If the hook 7 is engaged in a valley 8 remote from the first end of a string of pearls, part of the string hangs from the joint formed by the hook 7 and the valley 8. This design gives a fresh impression.

The size of the necklace is adjustable in a stepless manner by engaging the hook 7 in any of the valleys 8. Thus, by adjusting the size of the string necklace according to the neck thickness of the wearer, it is possible to form a necklace of such a size that fits each wearer best.

The illustrated necklace, which is of a length (48–49 cm) somewhere between princess and matinee, can be used as a choker, a princess and a matinee by adjusting the size of the loop of the necklace wearer has a neck of an average thickness.

FIGS. 4 through 7 show various examples of a hook provided at the second end of the string.

Figure 4:
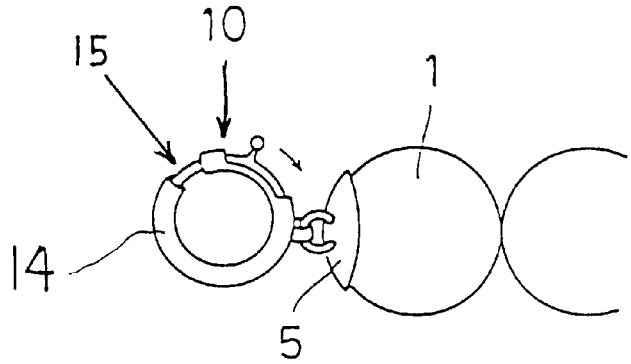
FIGS. 4–7 are views showing other examples of a hook of the present invention.

The hook 10 of FIG. 4 is a pull-ring of the same structure as commercial products, and the inner diameter of the ring is made smaller than the diameter of pearls 1. In particular, a circular sheath 14 includes an opening, and an opener 15 is slidably accommodated within the sheath 14.

Figure 5:
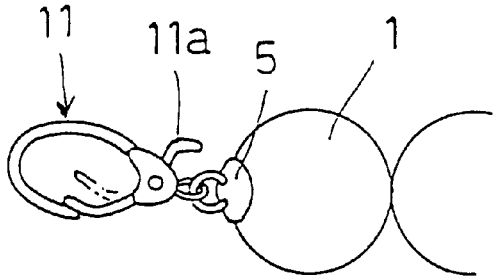

The hook 11 of FIG. 5 is a popular hook in which the mouth is closed by the force of a spring (not shown), and is opened by operating a lever 11*a*.

Figure 6:
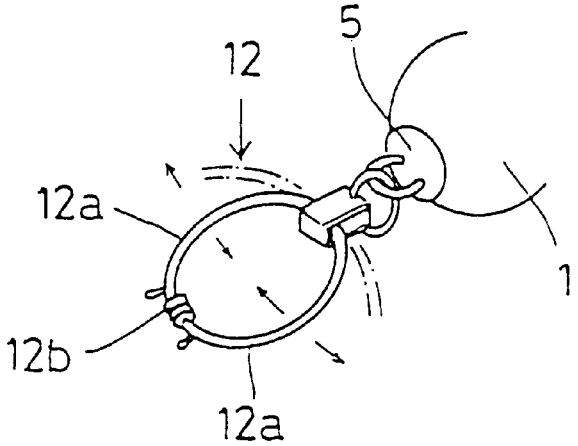

Also, the hook 12 shown in FIG. 6 is a center-bend type including a pair of arc-shaped members 12*a* connected to one another at a first end. The mouth of the hook is closed by permanent magnets 12*b* of different polarity mounted at the second ends of arc-shaped members 12*a*. The permanent magnets 12*b* may be replaced by another connector such as a pair of engaging tools.

Figure 7:
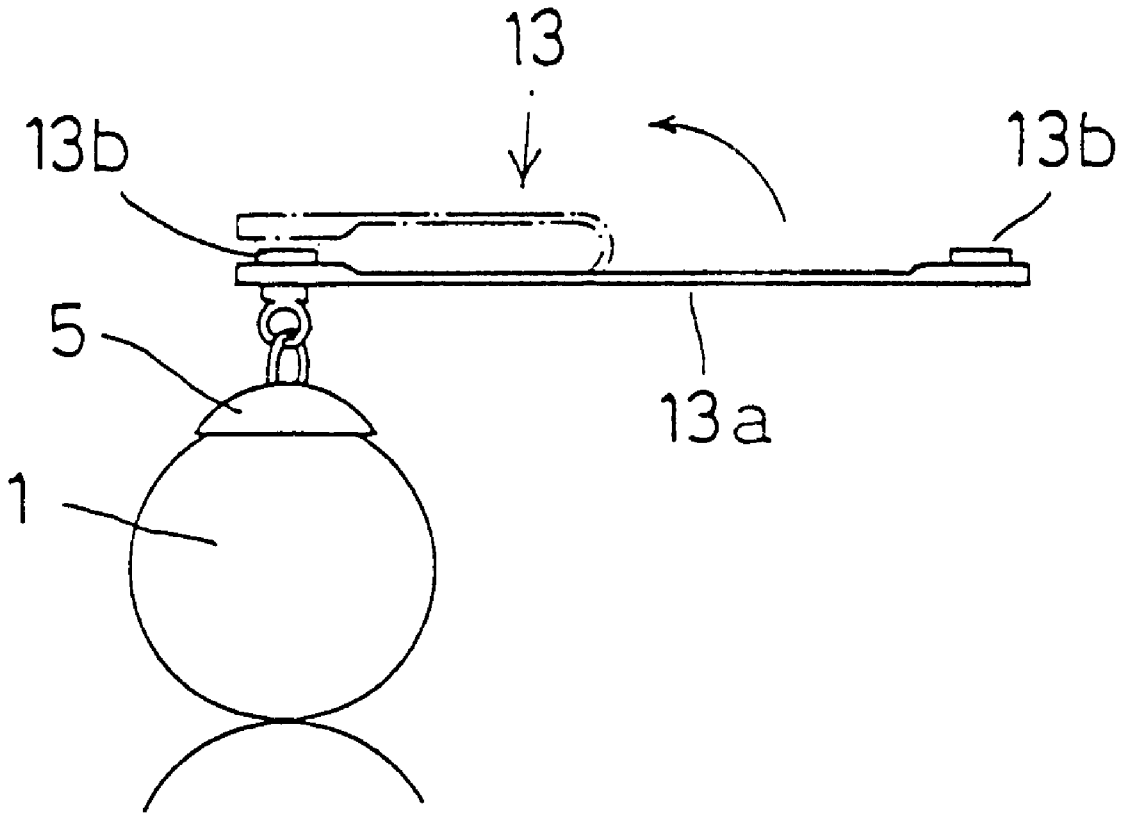
Figure 8A:
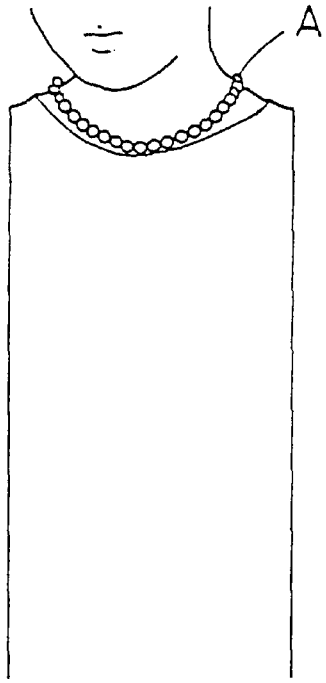
FIG. 8A–8D show choker, princess, matinee and opera necklaces, respectively.
Figure 8B:
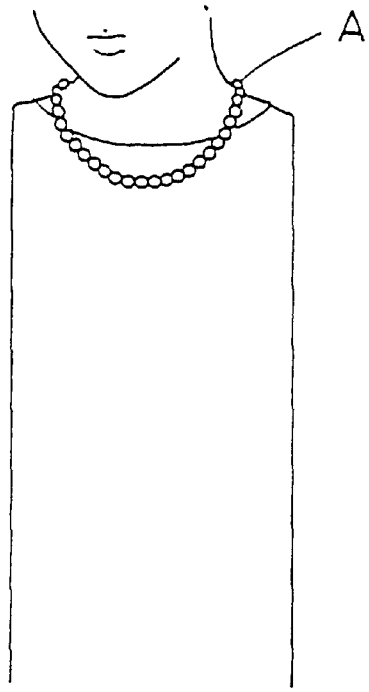
Figure 8C:
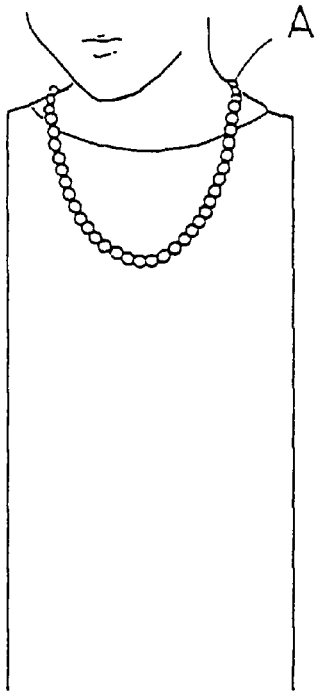
Figure 8D:
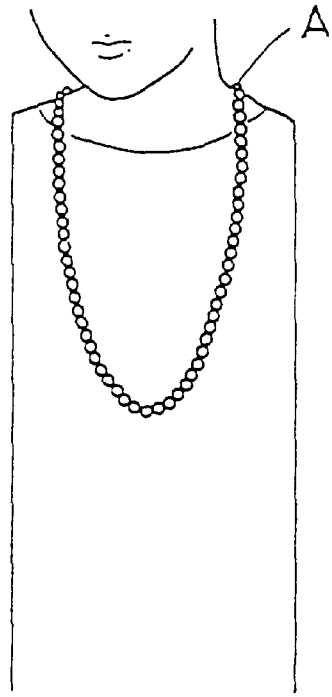

The hook 13 of FIG. 7 uses a strip 13*a* made of a soft resin (such as polyethylene and nylon) and folded in half. The ends of the strip are separably coupled together by a surface fastener 13*b* or a magnet.

In this way, the hook can take various forms.

Thus, anyone having a thick or slender neck can wear a necklace of a size that fits her best.

The same necklace looks quite different when both ends of the string are connected together and when one end is connected to an intermediate portion. Thus, the wearer can enjoy different designs with one necklace.

The hook is simple in structure, and can be manufactured easily at a low cost.

By changing the length of the string, one necklace can be used as choker, princess and matinee necklaces.

What is claimed is:

1. A necklace comprising:

a plurality of spherical objects;

a string having a first end and a second end, said string passing through said plurality of spherical objects so as to connect said plurality of spherical objects; and a hook connected to said second end of said string, said hook being formed of a material having a thickness such that said hook is adapted to be positioned in a valley between adjacent spherical objects of said plurality of spherical objects without widening said valley between said adjacent spherical objects, said hook being formed as a loop having a diameter smaller than an outer diameter of each of said spherical objects, said hook including a strip of soft resin material, said strip having a basal end and a connector on said basal end, and having a free end and a connector on said free end such that said basal end and said free end are engageable.

2. The necklace of claim 1, wherein said connector on said basal end and said connector on said free end comprise surface fasteners.

3. The necklace of claim 1, wherein said connector on said basal end and said connector on said free end comprise magnets.

* * * * *